US010350607B2

(12) United States Patent
Sutton et al.

(10) Patent No.: US 10,350,607 B2
(45) Date of Patent: Jul. 16, 2019

(54) PULVERIZER MONITORING

(71) Applicant: General Electric Technology GMBH, Baden (CH)

(72) Inventors: James P. Sutton, South Windsor, CT (US); David C Saunders, Simsbury, CT (US); Rebecca Lynn Tobiasz, Suffield, CT (US); Gerald Chase, West Suffield, CT (US)

(73) Assignee: General Electric Company, Schenectady, NY (US)

( * ) Notice: Subject to any disclaimer, the term of this patent is extended or adjusted under 35 U.S.C. 154(b) by 266 days.

(21) Appl. No.: 15/288,097

(22) Filed: Oct. 7, 2016

(65) Prior Publication Data

US 2017/0021361 A1 Jan. 26, 2017

Related U.S. Application Data

(62) Division of application No. 13/834,780, filed on Mar. 15, 2013, now Pat. No. 9,494,319.

(51) Int. Cl.
*B02C 23/04* (2006.01)
*B02C 15/04* (2006.01)
(Continued)

(52) U.S. Cl.
CPC ..... *B02C 23/04* (2013.01); *B02C 15/00* (2013.01); *B02C 15/04* (2013.01); *B02C 25/00* (2013.01);
(Continued)

(58) Field of Classification Search
CPC ..... F23K 1/00; F23K 2900/05001; F23K 2900/05141; F23K 5/16; B02C 25/00;
(Continued)

(56) References Cited

U.S. PATENT DOCUMENTS 5,839,673 A * 11/1998 Williams ..... B02C 21/00 241/48
2005/0263630 A1* 12/2005 Zhang ..... B02C 15/00 241/100
(Continued)

FOREIGN PATENT DOCUMENTS

CN 2006236254 U * 10/2016

OTHER PUBLICATIONS

Electric Power Research Institute (EPRI, Preventio, Detection, and Control of Coal Pulverizer Fires and Explosions, Feb. 1987), Riley Stoker Corporation, Worcester, Massachusetts.*

*Primary Examiner* — Anthony D Stashick
*Assistant Examiner* — Onekki P Jolly
(74) *Attorney, Agent, or Firm* — Frank A. Landgraff

(57) ABSTRACT

A system for detecting a combustion-related condition in a pulverizer includes a pulverizer configured to receive coal chunks via an inlet, to grind the coal chunks into coal powder and to output the coal powder via an outlet. The system includes sensors configured to detect heat input characteristics supplied to the pulverizer and heat output characteristics emitted from the pulverizer. The system also includes a controller configured to determine, based on signals from the sensors, whether a combustion-related condition exists in the pulverizer based on a heat balance function including the heat input characteristics and the heat output characteristics.

7 Claims, 3 Drawing Sheets

(51) Int. Cl.
*B02C 15/00* (2006.01)
*B02C 25/00* (2006.01)
*F23K 1/00* (2006.01)

(52) U.S. Cl.
CPC ..... *F23K 1/00* (2013.01); *F23K 2201/10* (2013.01); *F23K 2201/20* (2013.01)

(58) Field of Classification Search
CPC . B02C 23/04; B02C 15/00; F23N 5/10; F23N 5/102; F23N 5/105; F23N 5/107; F23N 5/14; F23N 5/143; F23N 5/146; G05B 2219/2627; G05B 23/0254; G05B 17/00; G01N 33/0063; G01N 21/00
USPC ..... 241/18, 23, 33, 37.5
See application file for complete search history.

(56) References Cited

U.S. PATENT DOCUMENTS

2009/0090799 A1* 4/2009 Musch ..... B02C 15/001 241/57
2009/0242676 A1* 10/2009 Fuller ..... B02C 15/006 241/203
2010/0065669 A1* 3/2010 Coles ..... A23B 4/031 241/5

* cited by examiner

PULVERIZER MONITORING

CROSS-REFERENCE TO RELATED APPLICATIONS

This application is a divisional of U.S. patent application Ser. No. 13/834,780, filed Mar. 15, 2013, all of which are incorporated by reference herein in their entireties.

TECHNICAL FIELD

Embodiments of the invention are directed to monitoring pulverizers and in particular to detecting a combustion-related condition in a pulverizer based on calculating a heat balance of the pulverizer.

BACKGROUND

Coal is used as a fuel in many power plants. Before the coal is introduced into the power plant it typically undergoes a pulverization process to reduce the size of the coal from relatively coarse chunks to a fine powder. This is done to increase the reactivity of the coal by increasing the effective surface area, to reduce surface moisture on the coal, and to make transportation of the coal into the furnace forming part of the power plant easier.

There are times during a pulverization process that the coal may ignite resulting in a fire inside a pulverizer. Fires can damage the pulverizer and cause safety risks to personnel, as well as causing delays in a power-providing system relying on the fine coal powder.

SUMMARY

According to the aspects illustrated herein, there is provided a system for detecting a combustion-related condition in a pulverizer includes a pulverizer configured to receive coal chunks via an inlet, to grind the coal chunks into coal powder and to output the coal powder via an outlet. The system includes sensors configured to detect heat input characteristics supplied to the pulverizer and heat output characteristics emitted from the pulverizer. The system also includes a controller configured to determine, based on signals from the sensors, whether a combustion-related condition exists in the pulverizer based on a heat balance function including the heat input characteristics and the heat output characteristics.

According to the other aspects illustrated herein, a method for detecting a combustion-related condition in a pulverizer includes measuring, with sensors, input heat characteristics of a pulverizer and output heat characteristics of the pulverizer. The method also includes detecting a combustion-related condition in the pulverizer by performing a heat balance operation including the input heat characteristics and the output heat characteristics.

According to other aspects illustrated herein, a pulverizer control system includes a processor configured to receive as inputs sensor signals corresponding to input heat characteristics of a pulverizer and output heat characteristics of the pulverizer, to determine whether a combustion-related condition exists in the pulverizer based on a heat balance equation including the input heat characteristics and the output heat characteristics, and to perform at least one of generating a signal indicating that a combustion-related condition exists in the pulverizer or controlling the pulverizer to take corrective action based on determining that the combustion-related condition exists in the pulverizer.

The above described and other features are exemplified by the following figures and detailed description.

BRIEF DESCRIPTION OF THE DRAWINGS

Referring now to the figures, which are exemplary embodiments, and wherein the like elements are numbered alike.

DETAILED DESCRIPTION

Figure 1:
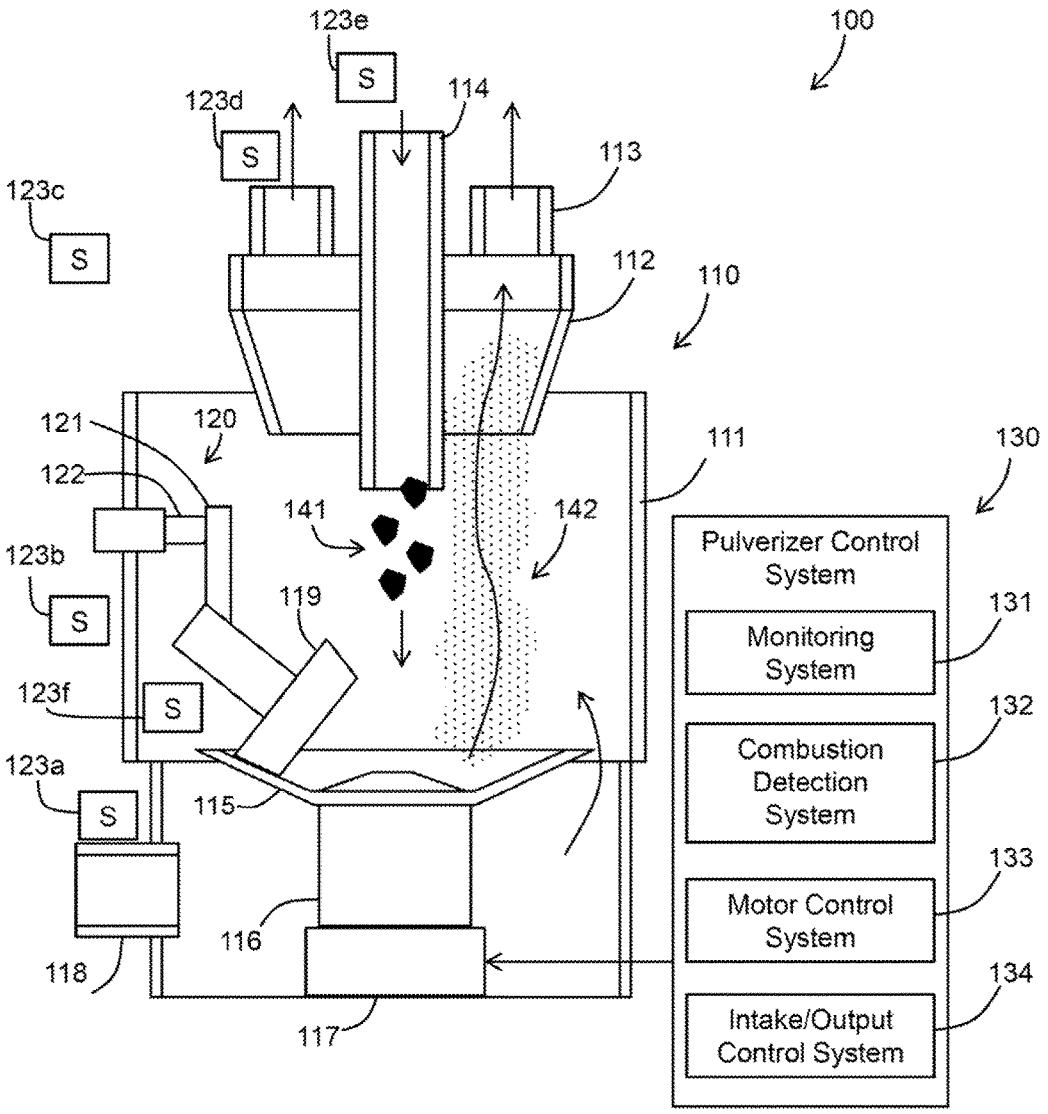
FIG. 1 is a diagram of a pulverizer system according to one embodiment.

FIG. 1 illustrates a pulverizer system 100 according to an embodiment of the invention. The system 100 includes a pulverizer 110 and pulverizer control system 130. The pulverizer 110 includes a housing 111. A drive assembly 117 is positioned in the housing 111. The drive assembly 117 includes one or more of a motor, gear box or gear system, or any other drive members. The drive assembly 117 rotates a pedestal 116 on which a coal grinding bowl 115 is mounted. One or more roll assemblies 119 are positioned in close proximity to the rotating coal grinding bowl 115. For example, in one embodiment there are three roll assemblies 119 positioned equidistantly approximately one hundred twenty degrees apart. Each of the roll assemblies is supported by a support assembly 120, which includes, for example, a support arm 121 and spring assembly 122. During operation, the roll assembly 119 rotates together with the rotation of the coal grinding bowl 115 and the spring 122 provides biasing force of the roll assembly 119 towards the coal grinding bowl 115.

A coal feed inlet 114, also referred to as a coal chunk inlet, coal inlet or inlet 114, extends into the housing 11 to allow coal chunks 141 to be inserted into the coal grinding bowl 115 in the housing 111. Drying and transport air is provided from an air duct 118 into the housing 111 which prevents ground coal powder 142 from falling down below the bowl and to direct the ground coal powder 142 up and away from the coal grinding bowl 115 towards a collection chute 112 and out a coal powder outlet 113. In addition, one or more additional air inlets may be provided to direct seal air flows into the housing 111, which keep the coal 141 and 142 from entering components such as bearings, gears and other moveable components under the bowl 115. From the coal powder outlet 113 the coal powder may be provided to a power generation system to burn the coal powder to generate electrical power, heat or any other type of power.

In embodiments of the invention, sensors 123*a* to 123*f* are positioned at multiple locations around the pulverizer 110 to detect characteristics of the pulverizer 110. In particular, the sensors 123*a* to 123*f* are configured to detect characteristics of the pulverizer 110 related to a heat balance algorithm or equation that represents heat sources supplied to the pulverizer 110 and heat emitted by the pulverizer 110. In FIG. 1, a sensor 123*a* is illustrated as being located near the air duct 118, also referred to as a drying and transport air inlet 118. The sensor 123*a* may detect the temperature of the drying and transport air or the humidity of the drying and transport air, for example. The sensor 123*b* is illustrated as being next to the housing 111. The sensor 123*b* may detect the temperature of the housing 111 to determine a convection heat of the housing 111. The sensor 123*c* is illustrated as being farther from the housing 111 than the sensor 123*b*. The sensor 123*c* may detect a temperature of air farther from the housing 111 to detect heat radiation of the pulverizer 110. Sensor 123*d* is illustrated as being near a coal powder outlet 113 of the pulverizer 110. The sensor 123*d* may detect the temperature of the air and coal powder emitted from the outlet 113 or a humidity of the air or coal powder emitted from the outlet 113. The sensor 123*e* is illustrated as being located near the coal chunk inlet 114 of the pulverizer 110. The sensor 123*e* may detect a temperature of air provided into the inlet 114. The sensor 123*f* may detect a temperature of heat generated by the grinding of coal in the coal grinding bowl 115.

While some examples of sensors and sensor location have been provided in FIG. 1, embodiments of the invention encompass any configuration of sensors to determine a heat balance equation or algorithm of the pulverizer 110. For example, one or more of the sensors 123*a*, 123*d* and 123*e* may measure a flow of air or solids. Embodiments of the invention also encompass pulverizers having additional sensors including vibration sensors, load sensors or any other sensors. In one embodiment, the sensors 123*a* to 123*f* detect heat characteristics, humidity characteristics and mass characteristics of air and coal into and out from the pulverizer 110, as well as inside the pulverizer 110. Examples of measured characteristics include a primary air temperature of air input via the coal chunk inlet 114, an air/fuel ratio of air and coal chunks 141 input via the coal chunk inlet 114, a fuel burn rate of coal powder 142 in a combustion system downstream from the coal powder outlet 113, coal inlet 114 temperature and moisture of air entering the inlet 114 or the outlet 113. Other examples of measured characteristics include the moisture of coal chunks 141 entering the pulverizer 110, moisture of coal powder 142 exiting the pulverizer 110, and a temperature at the coal powder outlet 113. Other examples of measured characteristics include a drying and transport air source temperature at the inlet 118, a drying and transport air flow, a seal air flow temperature and a seal air flow.

The pulverizer control system 130 monitors and controls operation of the pulverizer 110. The monitoring system 131 may include processing circuitry that receives data from the sensors 123*a* to 123*e* and controls the drive assembly 117 via the motor control system 133 according to the sensor data as well as user inputs or control data from systems external to the pulverizer control system 130. A combustion detection system 132 receives as inputs the sensor data corresponding to heat, humidity and flow data, for example, and generates a heat balance algorithm based on the received sensor data, or feeds the received sensor data into a predetermined heat balance algorithm. If a predetermined imbalance or characteristic is detected in the heat balance algorithm, the combustion detection system 132 determines that there is a combustion-related condition in the housing 111. The combustion detection system 132 may generate a warning or notice to a user that there is a combustion-related condition, or the combustion detection system 132 may send control signals to the motor control system 133 and the intake/output control system 134 to automatically control the rotation of the drive assembly 117, to halt air inflow via the air inlet 118, to halt coal chunk 141 input via the coal chunk inlet 114 and to halt coal powder output from the coal powder outlet 113.

In the present specification and claims, the term "combustion-related condition" refers to combustion, such as smoldering or flame and to conditions identified as leading to combustion and being precursors of combustion in a pulverizer 110. Accordingly, the combustion detection system 132 detects conditions corresponding to an existing flame, such as an imbalance in a heat balance equation above a threshold corresponding to a flame, and the combustion detection system 132 detects combustion-related conditions that lead to flames in the pulverizer 110, such as high humidity levels at the outlets 113 of the pulverizer 110, the pulverizer 110 operating at a threshold coal-flow level that may lead to overflow of coal into the drive assembly 117 or any other combustion-related condition.

In one embodiment of the invention, the algorithm used to compute a heat balance or energy balance in the pulverizer 110 is as follows:

$$\sum_{\substack{i=1\\ out}}^{n} \dot{m}_i h_i + \sum_{\substack{j=1\\ in}}^{k} \dot{m}_j h_j = \Sigma \dot{Q}$$

In this embodiment, m=mass flow of one or more of air, water vapor and coal, h=enthalpy of the air, water vapor, and/or coal and Q=energy flux, or change in energy. When there is no fire in the pulverizer 110, the net energy flux Q is zero. In one embodiment, the fire detection system determines that there is a flame in the pulverizer 110 when Q=+/−0.05. In one embodiment, to calculate the heat balance, the following are measured: dry air entering the pulverizer 110 via the inlet 114; water vapor in the air stream of the inlet 114, dry air of the drying and transport air stream at the inlet 118 and thermal energy contributed to the pulverizer 110 as a function of the grinding process.

Air enters the pulverizer 110 through several sources. These include hot air supplied via the mill inlet duct 114, or coal chunk inlet 114, and the drying and transport air introduced via the air inlet 118 to prevent infiltration of coal into the drive assembly 117. In an embodiment in which the pulverizer 110 operates under suction, ambient air from the coal chunk inlet 114 may infiltrate the drive assembly 117 components to replace seal air. The inlet air provided via the mill inlet duct 114, or coal chunk inlet 114, is drawn into the mill inlet duct from external sources. At least a portion of the air may be passed through a heat exchanger to raise its energy level of the air. The remainder of the mill inlet air is bypassed around the air heater and reintroduced as tempering air upstream of the mill inlet duct 114. Dampers on both a hot air stream and a tempering air stream control the total quantity of air to the mill while the relative quantities contributed by each is controlled based on the temperature measured at the mill outlet. The quantity and temperature of the air reaching the mill inlet duct 114 are measured so that their respective values are known.

The humidity ratio of air entering the inlet 114 and exiting the outlet 113 is measured, and the mass flow of water in the incoming air stream to the inlet 114 is determined as well as the mass flow of dry air in the incoming air stream to the inlet 114. In addition, the humidity of air entering the inlet 118 may also be added to the air entering the inlet 114 in the humidity ratio. Once this is known, the change in enthalpy of water vapor and dry air from the pulverizer inlet to pulverizer outlet temperatures can be determined. The sources of thermal energy into the pulverizer 110 have been identified and their respective contributions defined. The total energy into the pulverizer 110 is simply expressed as:

$Q_m = \Delta H_a + Q_{grind}$. This equation is the enthalpy of the total moist air stream entering the pulverizer 110 plus energy from the grinding.

Then, moisture evaporated from the surface of the coal may be measured by measuring outlet humidity (and based on the humidity ratio), the coal passing through the pulverizer 110 may be measured, such as by measuring the flow of coal chunks 141 into the pulverizer 110, and losses through the housing 111 may be measured, such as by temperature sensors 123*b* and 123*c*.

In embodiments of the invention, the pulverizer control system 130 may include any one computer or multiple computers interconnected via a network to monitor and control the pulverizer 110. The pulverizer control system 130 may include one or more processors and supporting logic and other circuitry, as well as memory and other computer-readable media that store computer programs to control operation of the pulverizer 110, to receive and analyze sensor signals and to detect fires in the pulverizer 110. Components of the pulverizer control system 130 may be connected to each other and to the pulverizer 110 via wires or wirelessly.

As discussed above, the pulverizer control system 130 and the combustion detection system 132 may detect conditions that may lead to fires prior to the fire being detected in the pulverizer 110. For example, the monitoring system 131 may detect a high humidity level at the outlet 113. The high humidity levels may lead to clumping of coal particles, which may lead to clogging of the outlet 113 or junctions and pathways downstream of the outlet 113, which may lead to fires. The pulverizer control system 130 may then generate a signal or message to warn of the humidity levels or potential fire, or may control the pulverizer 110 or external air supply systems to address the problem.

In another example, the pulverizer control system 130 may detect a flow of coal chunks 141 that is at a predetermined threshold corresponding to coal chunks 141 potentially falling out of the bowl 115 and into the drive system 17, which may in turn lead to fires. In particular, when the pulverizer 110 is operating at its drying capacity, high inlet temperatures and spillage may precede a fire. In such an embodiment, the pulverizer control system 130 may generate a warning or control the pulverizer 110 or external coal supply systems to address the fire to reduce the flow of coal into the pulverizer 110. While examples of preemptive fire-condition detection have been provided, embodiments of the invention encompass using sensors to detect any condition indicating a potential for fires and combustion in the pulverizer 110.

Figure 2:
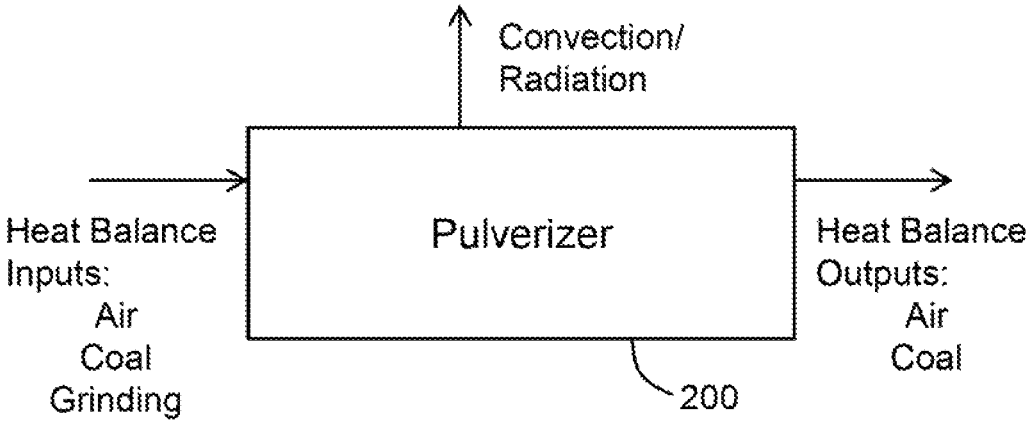
FIG. 2 is a function diagram of a heat balance algorithm of a pulverizer according to an embodiment of the invention.

FIG. 2 is a block diagram illustrating a heat balance calculation according to an embodiment of the invention. As discussed above, the heat balance calculation of a pulverizer 200 is calculated by measuring heat, humidity, mass and flow characteristics of air and coal entering and leaving the pulverizer 200, as well as heat generated by a grinding process in the pulverizer 200. The heat balance calculation also includes measuring convection and radiation of the pulverizer 200.

Figure 3:
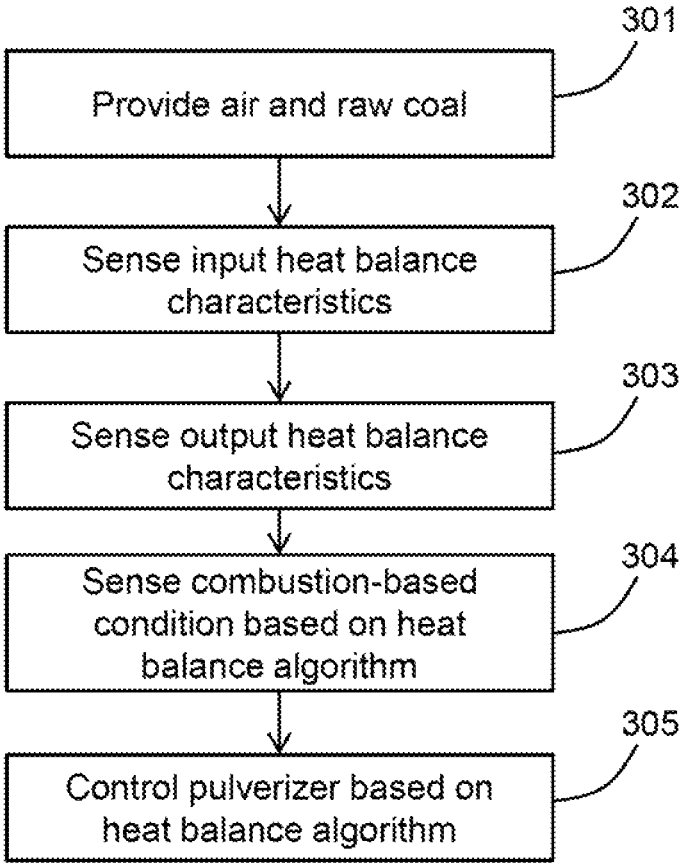
FIG. 3 is a flowchart illustrating a method according to one embodiment of the invention.

FIG. 3 illustrates a flowchart of a method according to an embodiment of the invention. In block 301, air and raw coal, or coal chunks, are provided to a pulverizer. The air is provided via an inlet that receives the coal chunks and supplies the coal chunks to a grinding bowl to be ground into coal powder. Air may also be provided from an inlet below the grinding bowl. This air, called drying and transport air, may be heated air that flows upward around the grinding bowl and lifts the coal powder towards an outlet while drying the coal. The coal powder may then be used in any process, such as a combustion process to generate heat or power.

In block 302, input heat balance characteristics of the pulverizer are detected. Input heat balance characteristics include the temperature, humidity and flow rate of air entering the pulverizer with coal chunks and the temperature, humidity and flow rate of air entering the pulverizer from below the grinding bowl. Another input heat balance characteristic is the thermal energy contributed to the pulverizer as a function of the grinding process.

In block 303, output heat balance characteristics are sensed. Output heat balance characteristics include the temperature, humidity and flow rate of air leaving the pulverizer via an outlet, such as the outlet from which coal powder leaves the pulverizer. Other output heat balance characteristics include convection and radiation energy of the pulverizer.

In block 304, a combustion-related condition is detected based on applying the input heat balance characteristics and output heat balance characteristics in a heat balance algorithm. In one embodiment, the input and output heat balance characteristics are compared with each other, and a difference is compared to a threshold value. The threshold value may be selected to correspond to a value at which a fire is likely in the pulverizer. For example, in one embodiment, the threshold value corresponds to a difference, such as five percent, between the heat input characteristics and heat output characteristics. In such an embodiment, if a difference of five percent or greater is detected, then it may be determined that there is a fire in the pulverizer. In one embodiment, a difference greater than zero but less than five percent may be considered a combustion-related condition that should be monitored or addressed to prevent the occurrence of a fire.

In block 305, the pulverizer is controlled based on the heat balance algorithm. For example, if it is determined that there is a fire or combustion-related condition in the pulverizer, inputs of air or coal may be halted, or outputs of air or coal may be halted.

Embodiments of the invention are directed to systems and apparatuses for detecting a combustion-related condition in a pulverizer and methods for detecting a combustion-related condition in a pulverizer. Embodiments are also directed to controllers, processors and other circuitry that detect combustion-related conditions in a pulverizer as well as computer-readable media that control a processor to detect a combustion-related condition in a pulverizer.

In one embodiment, a system for detecting a combustion-related condition in a pulverizer includes a pulverizer configured to receive coal chunks via an inlet, to grind the coal chunks into coal powder and to output the coal powder via an outlet. The system may include sensors configured to detect heat input characteristics supplied to the pulverizer and heat output characteristics emitted from the pulverizer. The system may also include a controller configured to determine, based on signals from the sensors, whether a combustion-related condition exists in the pulverizer based on a heat balance function including the heat input characteristics and the heat output characteristics.

In one embodiment, the system includes a grinding bowl in which the coal chunks are ground into the coal powder and a drying and transport air inlet located beneath the grinding bowl and configured to supply drying and transport air around the edges of the grinding bowl. In such an embodiment, the heat input characteristics measured by the sensors may include a temperature and a humidity level of the drying and transport air at the drying and transport air inlet.

In one embodiment, heat input characteristics include a temperature and humidity of air input to the inlet and heat generated by grinding the coal chunks into coal powder, and the output heat characteristics include a temperature and humidity of air at the outlet, a heat radiation of the pulverizer and a heat convection of the pulverizer.

In one embodiment of the system, the controller is further configured to control operation of the pulverizer based on detecting that a combustion-related condition exists in the pulverizer.

In one embodiment, one of the sensors is a humidity sensor at the outlet, and the controller is further configured to monitor the humidity of air at the outlet to determine whether a precursor condition to a flame in the pulverizer exists based on a humidity level below a predetermined threshold. In one embodiment, the controller is configured to determine whether the combustion-related condition exists in the pulverizer by calculating a difference between a sum of the heat input characteristics and a sum of the heat output characteristics, and by comparing the difference to a predetermined threshold that corresponds to a combustion-related condition.

In one embodiment, the heat balance function is:

$$\sum_{\substack{i=1\\ out}}^{n} \dot{m}_i h_i + \sum_{\substack{j=1\\ in}}^{k} \dot{m}_j h_j = \Sigma \dot{Q},$$

wherein mi is mass flow of air into the pulverizer, mj is mass flow of air out from the pulverizer, hi is enthalpy input to the pulverizer, hj is enthalpy output from the pulverizer and Q is a change in energy. In such an embodiment, the controller may be configured to detect the combustion-related condition by determining that Q is greater than a predetermined threshold. In one embodiment, the combustion-related condition is a flame and the predetermined threshold is +/−0.05.

In one embodiment, a method for detecting a combustion-related condition in a pulverizer includes measuring, with sensors, input heat characteristics of a pulverizer and output heat characteristics of the pulverizer. The method includes detecting a combustion-related condition in the pulverizer by performing a heat balance operation including the input heat characteristics and the output heat characteristics.

In one embodiment, detecting the combustion-related condition in the pulverizer includes calculating a difference between a combination of the input heat characteristics and a combination of the output heat characteristics and determining that the difference is greater than a predetermined threshold. In one embodiment, the method includes controlling the pulverizer to reduce a magnitude of the combustion-related condition based on detecting the combustion-related condition in the pulverizer.

In one embodiment, the heat input characteristics include a temperature and a humidity level of drying and transport air at a drying and transport air inlet, pulverizer configured to flow the drying and transport air upward from beneath a coal grinding bowl. In one embodiment, the heat input characteristics include a temperature and humidity of air input to a coal chunk inlet and heat generated by grinding the coal chunks into coal powder, and the output heat characteristics include a temperature and humidity of air at an outlet of the coal powder, a heat radiation of the pulverizer and a heat convection of the pulverizer.

In one embodiment, the method includes monitoring a humidity of air at a coal powder outlet of the pulverizer to determine whether a precursor condition to a flame in the pulverizer exists based on a humidity level below a predetermined threshold.

Yet another embodiment of the invention includes pulverizer control system including a processor. The processor may be configured to receive as inputs sensor signals corresponding to input heat characteristics of a pulverizer and output heat characteristics of the pulverizer, to determine whether a combustion-related condition exists in the pulverizer based on a heat balance equation including the input heat characteristics and the output heat characteristics, and to perform at least one of generating a signal indicating that a combustion-related condition exists in the pulverizer or controlling the pulverizer to take corrective action based on determining that the combustion-related condition exists in the pulverizer.

In one embodiment, the processor is configured to calculate a difference between a combination of the input heat characteristics and a combination of the output heat characteristics and to determine that a combustion-related condition exists when the difference is greater than a predetermined threshold.

Embodiments of the invention relate to conducting an accurate energy balance analysis with a pulverizer as the control volume. If the heat energy leaving the pulverizer does not equal the heat energy entering the Pulverizer there must be an additional heat source which then indicates a fire. Some technical advantages of embodiments of the invention include the capability to detect a fire at a heat level equal to 5% of heat input regardless of the a fire's location. Embodiments of the invention also reduce the probability of a fire occurring by identifying important precursors. These precursors include high humidity in the outlet pipe which increases the probability of a blocked coal line, which in turn, leads to elevated risk of a fire, and operation of the pulverizer in a regime exceeding its drying capability.

While the invention has been described with reference to various exemplary embodiments, it will be understood by those skilled in the an that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for detecting a combustion-related condition in a pulverizer, the system comprising:

a pulverizer configured to receive coal chunks via an inlet, to grind the coal chunks into coal powder and to output the coal powder via an outlet;

sensors configured to detect heat input characteristics supplied to the pulverizer and heat output characteristics emitted from the pulverizer; and a controller configured to determine, based on signals from the sensors, whether a combustion-related condition exists in the pulverizer based on a heat balance function including the heat input characteristics and the heat output characteristics;

wherein the heat balance function is:

$$\sum_{\substack{i=1 \\ out}}^{n} \dot{m}_i h_i + \sum_{\substack{j=1 \\ in}}^{k} \dot{m}_j h_j = \Sigma \dot{Q},$$

wherein $m_j$ is the mass flow into the pulverizer, $m_i$ is the mass flow of air out from the pulverizer, $h_j$ is the enthalpy input to the pulverizer, and $h_i$ is the enthalpy output from the pulverizer and Q is a change in energy, and the controller is configured to detect the combustion-related condition by determining that Q is greater than a predetermined threshold.

2. The system of claim 1, further comprising:

a grinding bowl in which the coal chunks are ground into the coal powder; and a drying and transport air inlet located beneath the grinding bowl and configured to supply drying and transport air around the edges of the grinding bowl, wherein the heat input characteristics measured by the sensors include a temperature and a humidity level of the drying and transport air at the drying and transport air inlet.

3. The system of claim 1, wherein the heat input characteristics include a temperature and humidity of air input to the inlet and heat generated by grinding the coal chunks into coal powder, and the output heat characteristics include a temperature and humidity of air at the outlet, a heat radiation of the pulverizer and a heat convection of the pulverizer.

4. The system of claim 1, wherein the controller is further configured to control operation of the pulverizer based on detecting that the combustion-related condition exists in the pulverizer.

5. The system of claim 1, wherein one of the sensors is a humidity sensor at the outlet, and the controller is further configured to monitor the humidity of air at the outlet to determine whether a precursor condition to a flame in the pulverizer exists based on a humidity level above a predetermined threshold.

6. The system of claim 1, wherein the controller is configured to determine whether the combustion-related condition exists in the pulverizer by calculating a difference between a sum of the heat input characteristics and a sum of the heat output characteristics, and by comparing the difference to a predetermined threshold that corresponds to the combustion-related condition.

7. The system of claim 1, wherein the combustion-related condition is a flame and the predetermined threshold is +/−0.05.

* * * * *